US007026766B2

(12) United States Patent
Maede et al.

(10) Patent No.: US 7,026,766 B2
(45) Date of Patent: Apr. 11, 2006

(54) ORGANIC EL ELEMENT DRIVE CIRCUIT AND ORGANIC EL DISPLAY DEVICE

(75) Inventors: Jun Maede, Kyoto (JP); Masanori Fujisawa, Kyoto (JP)

(73) Assignee: Rohm Co., Ltd., Kyoto (JP)

( * ) Notice: Subject to any disclaimer, the term of this patent is extended or adjusted under 35 U.S.C. 154(b) by 74 days.

(21) Appl. No.: 10/798,277

(22) Filed: Mar. 12, 2004

(65) Prior Publication Data

US 2004/0169478 A1 Sep. 2, 2004

Related U.S. Application Data

(62) Division of application No. 10/393,920, filed on Mar. 24, 2003, now Pat. No. 6,747,417.

(30) Foreign Application Priority Data

Mar. 27, 2002 (JP) ..... 2002-087951

(51) Int. Cl.
*G09G 3/10* (2006.01)
*G09G 5/00* (2006.01)

(52) U.S. Cl. ..... 315/169.1; 315/169.3; 345/204

(58) Field of Classification Search ..... None
See application file for complete search history.

(56) References Cited

U.S. PATENT DOCUMENTS 6,586,888 B1 7/2003 Kitahara et al. ..... 315/169.1
6,756,738 B1 * 6/2004 Maede et al. ..... 315/169.1
2002/0180490 A1 12/2002 Voorman et al. ..... 327/53
2003/0151374 A1 8/2003 Maede et al. ..... 315/169.1
2004/0085025 A1 * 5/2004 Maede et al. ..... 315/169.3
2004/0155840 A1 * 8/2004 Abe et al. ..... 345/76
2005/0024300 A1 * 2/2005 Abe et al. ..... 345/76

FOREIGN PATENT DOCUMENTS

JP 10-112391 4/1998
JP 2001-42827 2/2001

OTHER PUBLICATIONS

U.S. Appl. No. 10/102,621, filed Mar. 22, 2002, Leon McCaughan.

* cited by examiner

*Primary Examiner*—Trinh Vo Dinh
(74) *Attorney, Agent, or Firm*—Mattingly, Stanger, Malur & Brundidge, P.C.

(57) ABSTRACT

An organic EL element drive circuit includes a current mirror circuit, a first current output circuit for generating a current having a first value in response to an output current of one of output side transistors of the current mirror circuit and a current generator circuit. An input terminal of the organic EL element drive circuit is supplied with a current having a second value from a second current output circuit of another organic EL element drive circuit preceding to the organic EL element drive circuit, which has substantially the same construction as that of the first current output circuit, to generate a predetermined drive current and the input transistor of the current mirror circuit is driven by the predetermined drive current to generate the first current value corresponding to the second current value.

19 Claims, 2 Drawing Sheets

ORGANIC EL ELEMENT DRIVE CIRCUIT AND ORGANIC EL DISPLAY DEVICE

This is a divisional application of U.S. Ser. No. 10/393,920, filed Mar. 24, 2003 now U.S. Pat. No. 6,747,417.

BACKGROUND OF THE INVENTION

1. Field of the Invention

The present invention relates to an organic EL (Electro Luminescence) element drive circuit and an organic EL display device and, in particular, the present invention relates to an organic EL element drive circuit of a simple matrix type organic EL panel used in a portable telephone set, etc., which is capable of reducing luminance variation on a screen of an organic EL display device due to difference in characteristics between current driver ICs and is suitable for a high luminance color display and the organic EL display device.

2. Description of the Related Art

Since an organic EL display device can perform a high luminance display due to spontaneous light emission, the organic EL display device is suitable for use in a display device whose display screen size is small and is expected as the next generation display device to be mounted on such as a portable telephone set, a DVD player or a PDA (personal digital assistance), etc. A known problem of the organic EL display device is that variation of luminance becomes considerable when a voltage drive is applied to the organic EL display device as in a liquid crystal display device and the drive control becomes difficult due to the difference in sensitivity between R (red), G (green) and B (blue).

In view of this problem, an organic EL display device using a current driver is proposed recently. For example, in JP H10-112391A, a technique for solving the problem of luminance variation by employing the current drive is disclosed.

In a recent organic EL display panel of an organic EL display device for use in a portable telephone set, the number of terminal pins of column lines is 396 (132×3) and the number of terminal pins of row lines is 162. These numbers of the terminal pins are still increasing.

With such increase of the number of terminal pins, a plurality of column IC drivers is three currently and the number of terminal pins of each driver for one of R, G and B in the case of full color display is 44, so that the total number of the terminal pins of the three drivers becomes 132. Therefore, there is a problem that luminance variation occurs on a screen of an organic EL display device due to difference in characteristics between the column IC drivers, particularly, due to variation of drive circuits thereof.

In, for example, U.S. application Ser. No. 10/102,671, which corresponds to Japanese Application JP 2002-82662 claiming domestic priorities of Japanese Application JP2001-86967 and JP2001-396219, a technique for solving this problem is disclosed.

Further, JP H2001-42827A discloses another technique for solving the above problem.

In U.S. application Ser. No. 10/102,671, in order to prevent luminance variation due to difference in characteristics between a plurality of column IC drivers, a drive stage is constructed with a current mirror circuit including an input side transistor and a plurality of parallel-connected output side transistors, so that drive currents for column pins are generated. By arranging the input side transistor of the current mirror circuit at a center of the output side transistors thereof, the pin drive current flowing through the first output pin of the column IC driver is made substantially equal to that flowing the last output pin. Further, the pin drive current flowing the last output pin in a certain column IC driver and the pin drive current flowing the first output pin of a next column IC driver are regulated by selecting resistance values thereof by means of laser trimming such that these pin drive currents become specific values with which the drive current characteristics of the column IC drivers become equal and the luminance variation problem is solved.

On the other hand, in order to solve the problem of the difference in characteristics between the column IC drivers, JP H2001-42827A utilizes a current mirror circuit having similar construction to that in U.S. application Ser. No. 10/102,671. However, an output current of the last output side transistor of the current mirror circuit is derived externally of the IC and inputted to a next column IC driver such that the drive current of the input side transistor is made equal to that of the input side transistor of the first column IC driver. Although the pin drive currents of the column IC drivers may be made substantially equal, it is practically difficult to effectively utilize this technique.

FIG. 2 is a circuit diagram disclosed in JP H2001-42827A. In FIG. 2, an initial stage column IC driver (first anode line drive circuit) 21 includes a reference current control circuit RC, a control current output circuit CO, a switch block SB having switches S1 to Sm, and m current drive sources provided correspondingly to respective pins. The m current drive sources are constructed with transistors Q1 to Qm and resistors R1 to Rm, respectively. A next stage column IC driver (second anode line drive circuit) 22 includes a drive current output circuit CC, a switch block including switches S1 to Sm and m current drive sources provided correspondingly to respective pins. The m current drive sources are constructed with transistors Q1 to Qm and resistors R1 to Rm, respectively. Output currents i of the transistors Q1 to Qm of the drivers are supplied to the pins through the switches S1 to Sm and output terminals X1 to Xm, respectively.

The reference current control circuit RC is constructed with an operational amplifier OP supplied with a reference voltage $V_{REF}$, a transistor Qa, which is driven by an output of the operational amplifier OP supplied to a base thereof, resistor Rp provided between an emitter of the transistor Qa and ground and a transistor Qb having a collector, which is connected to a collector of the transistor Qa on an upstream side of the transistor Qa. A voltage generated by the resistor Rp is fedback to an input of the operational amplifier OP, so that the reference current control circuit constitutes a constant current source. An emitter of the transistor Qb is connected to a power source line $V_{BE}$ (corresponding to a power source line $V_{DD}$ of the display device) through a resistor Rr.

The transistor Qb constitutes an input side current mirror circuit together with the transistors Q1 to Qm and a transistor Qo of the control current output circuit CO and is driven by a reference current $I_{REF}$ generated by the reference current control circuit RC.

The drive current output circuit CC of the driver 22 corresponds to the reference current control circuit RC. The drive current output circuit CC is constructed with a current mirror circuit including transistors Qc and Qd and a transistor Qe driven by the output side transistor Qd of the current mirror circuit. The input side transistor Qc of the driver 22 is supplied with an output current Iout of the control current output circuit CO of the driver 21, which is ic, to drive the transistor Qe of the driver 22. The transistor Qe of the driver 22 is an input side transistor of the transistors Q1 to Qm constituting a current mirror circuit. Values of the resistors Ro and Rr are equal and a value of the resistor Rs is equal to a value of the parallel resistors R1 to Rm. The switches S1 to Sm of the switch block SB of the driver 21 are ON/OFF controlled by control signals GA1 to GAm and the switches S1 to Sm of the switch block SB of the driver 22 are ON/OFF controlled by control signals GB1 to GBm.

As another circuit construction, a current drive circuit is provided in a position corresponding to the switch block SB in each of the drivers. In the current drive circuit, input side transistors are provided correspondingly to terminal pins and a pair of current mirror current output circuits having output side transistors connected to terminal pins are provided. The switching operation of the current drive circuit is ON/OFF controlled by the control signals GA1 to GAm. In this circuit, the current mirror output circuit becomes a drive stage, which generates the mirror currents correspondingly to the terminal pins according to a reference current from a reference current generator circuit (corresponding to the reference current control circuit RC) as an input stage preceding to the drive stage. Alternatively, the mirror currents distributed to the terminal pins are amplified by k times (k is an integer equal to or larger than 2) and drive the output circuits.

In the current drive circuit disclosed in Japanese Application JP2002-82662, D/A converter circuits are provided correspondingly to the terminal pins as the k-time amplifier circuits. The D/A converter circuits receive display data corresponding to the column side terminal pins and the column side drive currents for the respective terminal pins for one line are generated simultaneously by A/D converting the column data.

A problem of the current drive circuit in which the current mirror circuit for parallel driving a plurality of output side transistors is used in the drive stage or the output stage will be described with reference to the IC driver circuits 21 and 22 shown in FIG. 2.

In the circuit shown in FIG. 2, the output current Iout=ic of the transistor Qo of the column IC driver circuit 21 is supplied to the transistor Qe of the column IC driver circuit 22 through the current mirror transistors Qc and Qd. Therefore, the output current should be the current i equal to the reference current $I_{REF}$ theoretically. However, even if the reference currents are made equal between chips in this manner, characteristics ($h_{fe}$ and Early voltage, etc.) of transistors of the converter circuit and the output circuit are different between chips. Therefore, it is difficult to make actual output currents precisely coincident between chips. Further, since the reference current i is generated by the column IC driver 22 upon reception the current Iout, which is one of the output currents of the column IC driver 21, a difference between the reference current i of the column IC driver 22 and the reference current $I_{REF}$ of the column IC driver 21 becomes large, so that the luminance variation in the boarder region between the drivers can not be removed sufficiently.

In this view point, the technique disclosed in Japanese Application JP2001-86967 can remove such luminance variation since the drive currents in specific positions are regulated for every driver unlike the case where the output current (drive current) sent as shown in FIG. 2. However, since, in JP2001-86967, it is necessary to select the values of resistors to be trimmed by laser trimming for every column IC driver during the fabrication of the drive circuit, there is another problem that the fabrication efficiency is lowered.

SUMMARY OF THE INVENTION

An object of the present invention is to provide an organic EL element drive circuit capable of reducing the luminance variation on a screen of an organic EL display device due to difference of characteristics between the current driver ICs of an organic EL panel of a portable telephone set, etc.

Another object of the present invention is to provide an organic EL display device capable of reducing the luminance variation on a screen of an organic EL display device due to difference of characteristics between the current driver ICs of an organic EL panel.

In order to achieve these objects, an organic EL element drive circuit according to the present invention, which includes a current mirror circuit having an input side transistor supplied with a predetermined drive current and a plurality of output side parallel transistors, from which drive currents or currents, from which the drive currents are derived, to be supplied to terminal pins of an organic EL panel are derived, is featured by comprising a current output circuit for generating a current having a first value in response to an output current of one of the output side transistors and a current generator circuit for generating the predetermined drive current in response to a current having a second value outputted by another organic EL element drive circuit preceding to the organic EL element drive circuit and having a current output circuit and a current mirror circuit substantially the same as the current output circuit and the current mirror circuit of the organic EL element drive circuit, the current having the second value being outputted from the current output circuit of the another organic EL element drive circuit.

In the present invention, the first current output circuit responsive to the output current of the output side transistors of the current mirror circuit, for generating the first current value and the current generator circuit are provided in the organic EL element drive circuit of a first driver. A current having a first value corresponding to the second current value is generated by driving the input side transistor of the current mirror circuit of the first driver with the predetermined drive current generated by a second current output circuit in the organic EL element drive circuit of a second driver having substantially the same construction as that of the first driver and preceding to the first driver in response to a current having a second value from the second current output circuit through an input terminal of the first driver.

In this case, since the first and second current output circuits are identical and each receives the output current of one of the output side transistors in its organic EL element drive circuit, the values of the output currents of these circuits become equal. Therefore, even if there is a difference in characteristics (particularly, $h_{fe}$) of the transistors constituting the reference current generator circuit, the transistors constituting the current mirror circuit and the transistors constituting the current output circuit between the drivers, the current values of the current output circuits become equal, so that the difference in pin drive current between the organic EL element drive circuits is restricted.

In this case, the output transistors of the current mirror, output currents of which are received by the current output circuits of the respective drivers, are preferably positioned in the same positions, respectively. Incidentally, the output transistors of the current mirror circuit, outputs of which are received by the current output circuit, may not always be those generating the pin drive currents.

As a result, the luminance variation on the display screen can be reduced and it becomes possible to realize the organic EL panel capable of performing high luminance color display.

DETAILED DESCRIPTION OF THE PREFERRED EMBODIMENTS

Figure 1:
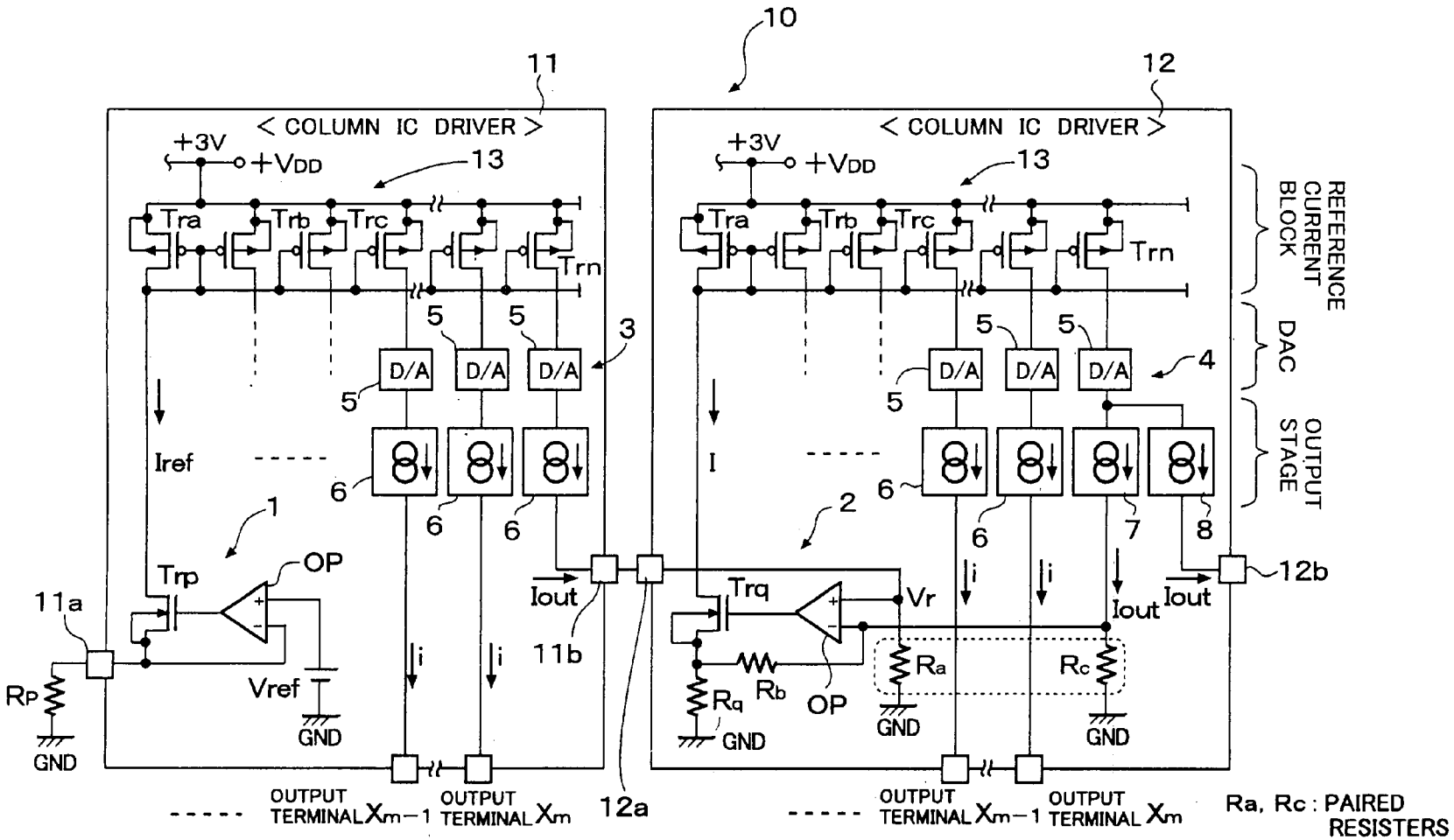
FIG. 1 is a block circuit diagram showing a column driver and associated portions of a simple matrix type organic EL panel using organic EL element drive circuits according to an embodiment of the present invention.
Figure 2:
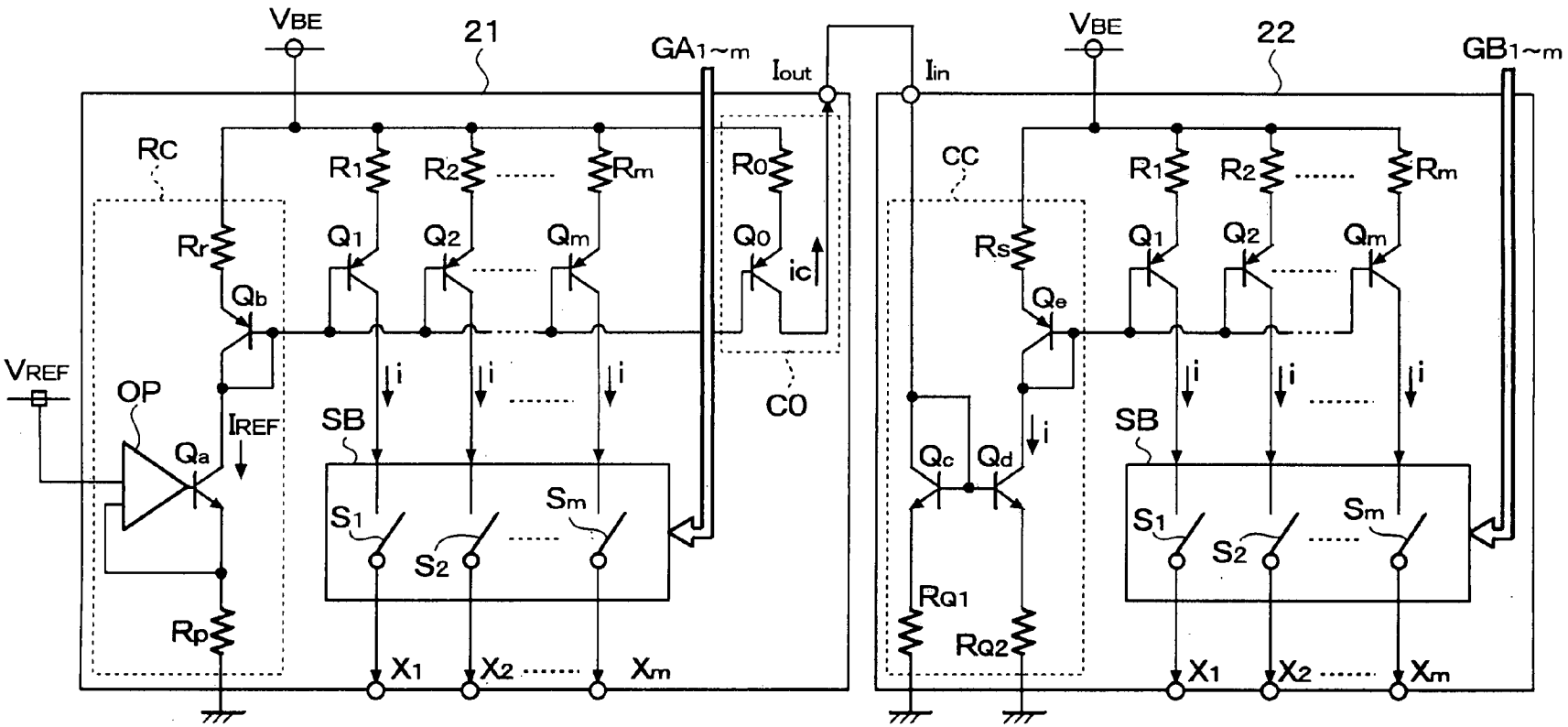
FIG. 2 PRIOR ART
FIG. 2 is a block circuit diagram of a conventional organic EL element drive circuit.

In FIG. 1 in which similar components to those shown in FIG. 2 are depicted by the same reference numerals, respectively, an organic EL panel 10 includes column IC drivers 11 and 12 of an organic EL element drive circuit thereof.

The column IC drivers 11 and 12 include reference current generator circuits 1 and 2, in lieu of the reference current control circuit RC and the drive current output circuit CC shown in FIG. 2, and current output circuits 3 and 4, respectively. The column IC drivers 11 and 12 except the reference current generator circuits 1 and 2 and the output circuits 3 and 4 have substantially the same constructions and include current mirror circuits 13 having identical construction, respectively.

The reference current generator circuit 1 of the column IC driver 11 is constructed with an operational amplifier OP, an N channel transistor Trp driven by an output of the operational amplifier OP supplied to a gate thereof and a resistor Rp provided between a source of the transistor Trp and ground, similarly to the reference current control circuit RC shown in FIG. 2. The reference current generator circuit 1 drives a P channel MOS FET Tra having a drain connected to a drain of the transistor Trp on a downstream side of the transistor Trp.

The current mirror circuit 13 includes the transistor Tra and P channel MOS FET Trb to Trn, which are current-mirror connected to the transistor Tra. Sources of the transistors Trb to Trn are connected to a power source line +VDD of +3V. A (+) input of the operational amplifier OP is grounded through a reference voltage source Vref and a (−) input thereof is connected to a source of the transistor Trp and a terminal 11*a* of the IC. The resistor Rp is provided externally of the IC.

Drains of the transistors Trb to Trn are connected to the D/A converter circuits 5. The D/A converter circuits are responsive to display data to generate drive currents corresponding to luminance of display on the basis of reference drive currents outputted by the transistors and supply the drive currents to output stage current source 6, respectively. The output stage current sources 6 each constructed with a current mirror circuit composed of a pair of transistors output currents i to the terminal pins of the organic EL panel through output terminals X1 to Xm, respectively.

The drain of the last stage transistor Trn is connected to the D/A converter circuit 5 to drive the latter. The D/A converter circuit 5 drives the output stage current source 6 correspondingly to data set therefor and the output stage current source 6 outputs an output current Iout externally of the IC through an output terminal 11*b*. In this embodiment, the last stage of the current output circuit 3 is constructed with the transistor Trn, the D/A converter circuit 5 and the output stage current source 6.

The reference current generator circuit 2 of the column IC driver 12 is constructed with an operational amplifier OP, an N channel transistor Trq driven by an output of the operational amplifier OP supplied to a gate thereof and a resistor Rq provided between a source of the transistor Trq and ground, similarly to the reference current control circuit RC shown in FIG. 2. The reference current generator circuit 1 drives a P channel MOS FET Tra having a drain connected to a drain of the transistor Trq on a downstream side of the transistor Trq. The current mirror circuit 13 includes the transistor Tra and P channel MOS FET Trb to Trn, which are current-mirror connected to the transistor Tra. Sources of the transistors Tra to Trn are connected to a power source line +VDD of +3V. A (+) input of the operational amplifier OP is grounded through a resistor Ra and is connected to an input terminal 12*a* of the IC. A (−) input thereof is connected to a source of the transistor Trq through a resistor Rb.

The resistor Rq is provided in the IC and has a value substantially equal to that of the resistor Rp of the IC driver 11.

The input terminal 12*a* is connected to the output terminal 11*b* of the column IC driver 11 and is supplied with the current Iout from the output stage current source 6 of the column IC driver 11.

The current output circuit 4 of the column IC driver 12 is constructed with the last stage transistor Trn, a last stage D/A converter circuit 5, output stage current sources 7 and 8 and a resistor Rc. The last stage D/A converter circuit 5 and the output stage current source 8 are identical to the D/A converter circuit 5 and the output stage current source 6 of the current output circuit 3, respectively, and the output stage current source 7 is substantially identical to the output stage current source 6.

The drain of the last stage transistor Trn of the column IC driver 12 is connected to the D/A converter circuit 5 to drive the latter. The D/A converter circuit 5 drives the output stage current sources 7 and 8 correspondingly to the data inputted and the output current Iout of the current source 8 is outputted externally from the output terminal 12*b*.

The output of the output stage current source 7, which is Iout, is grounded through the resistor Rc.

Although the output stage current sources 7 and 8 are independent from each other in FIG. 1, one of the output side transistors may be used therefor by constructing them with a current mirror circuit.

The resistance value of the resistor Ra is equal to that of the resistor Rc and these resistors are provided as paired resistors. The resistance value of the resistor Ra as well as the resistor Rc is selected such that, when the output current Iout from the column IC driver 11 flows therethrough, a voltage Vr substantially corresponding to the voltage of the reference power source Vref is generated across the resistor Ra. On the other hand, the transistor Trp of the reference current generator circuit 1 is responsive to the voltage of the reference power source Vref to generate an output current (drive current) Iref. With respect to this current Iref, the current Iout is generated in the output current source 6 of the column IC driver 11. It is assumed here that; even when the voltage Vr substantially corresponding to the voltage of the reference power source Vref is generated across the resistor Ra of the reference current generator circuit 2 in response to the current Iout, the output current (drive current) of the transistor Trq becomes not Iref but I since $h_{fe}$ of the transistor Trq is different from that of the transistor Trp.

However, in this reference current generator circuit 2, the output current (drive current) I generated by the transistor Trq is controlled by feeding back the voltage across the resistor Rc supplied with the current Iout from the output current source 7 to the (−) input of the operational amplifier OP having the (+) input at the voltage Vr generated across the resistor Ra due to the current Iout flowing therethrough.

As a result, the voltage of the resistor Rc becomes equal to Vr, which is the voltage of the resistor Ra. Since the resistors Rc and Ra are formed as the paired resistors and have substantially equal resistance values, the current flowing through the resistor Rc becomes the current Iout inputted from the output stage current source 6 of the column IC driver 11. That is, the output current of the output stage current source 8 as well as the output stage current source 7 is controlled such that it becomes the output current Iout of the column IC driver 11. According to this control, the drive current I of the transistor Trq is determined by the output current Iout flowing through the last stage transistor Trn of the column IC driver 12 regardless of $h_{fe}$ of the transistor Trq and $h_{fe}$ of the output side transistor Trb to Trn.

As a result, the output currents of the last stage transistors Trn of the column IC drivers 11 and 12 become equal to Iout, respectively, and, under this condition, the drive currents i are supplied to the terminal pins of the organic EL panel from the output terminals X1 to Xm of the respective column IC drivers 11 and 12.

As described, in the present invention, the control is performed in such the way that not the current values of the reference current generator circuits 1 and 2 of the column IC drivers but the output currents Iout of the current sources 6 and 7 supplied with the output currents of the output side transistors Trn arranged in the positions substantially the same as those of the current mirror circuits of the column IC drivers becomes equal to each other. As a result, the difference between pin drive currents of the respective organic EL element drive circuits is restricted.

The display data are set in the D/A converter circuits 5 except the D/A converter circuits driven by the transistors Trn of the column IC drivers 11 and 12 and data having the same data values are set in the D/A converter circuits driven by the transistors Trn of the column IC drivers 11 and 12. In this case, the data set in the D/A converter circuits driven by the transistors Trn are preferably a maximum luminance display data with all of bits thereof being "1". In such case, the maximum current value Iout, which is the maximum value of the pin drive current i, is generated by the last stage current source 6 of the column IC driver 11 and the output stage current sources 7 and 8 of the column IC driver 12 with which the respective pin drive currents i are controlled.

Therefore, the drive currents of the transistors Tra to Trn are controlled such that these drive currents become those with which the output stage current source 8 generates the output current Iout and the drive currents i outputted to the organic EL panel from the output stage current sources 6 through the output terminals X1 to Xm are controlled by the respective column IC drivers 11 and 12 such that the drive currents generate output currents i corresponding to the display data.

As a result, the luminance variation on the screen due to the difference in characteristics between the current driver ICs, particularly, the difference in drive current therebetween is reduced.

In this embodiment, the output stage current sources 7 and 8 are provided in the column IC driver 12 driven by the output current Iout from the terminal 11*b* of the column IC driver 11. However, where there are only two column IC drivers, the output stage current source 8 is unnecessary. In such case, it is possible to perform the control for making the pin drive current value of the column IC driver 11 substantially equal to that of the column IC driver 12 by only the output stage current source 7.

In this embodiment, the resistor Rc is described as if it is a portion of the current output circuit 4 for simplicity of description. However, in view of generation of the drive current I of the transistor Trq, the resistor Rc may be considered as a portion of the reference current generator circuit 1. This is true particularly when the output stage current source 8 is absent. The reference current generator circuit 1 and the resistor Rc are a concrete example of the current generator circuit in view of the generation of the drive current I. It should be noted that the resistor Rc may be supplied with not the whole but a portion of the output current Iout from the output stage current source 7. In such case, the resistor Ra connected to the (+) input of the operational amplifier OP is supplied with a portion of the current Iout.

In the embodiment described hereinbefore, the input side transistor of the current mirror circuit in the column IC driver 11 receives the reference current from the reference current generator circuit and assigns one of the output side transistors of the current mirror circuit. And then, the output current Iout to be inputted to the column IC driver 12 is generated correspondingly to the output current of the assigned transistor. However, it is, of course, possible to generate the current to be outputted to the column IC driver 12 on the basis of the output side drive current corresponding to the reference current of the column IC driver 11 or the drive current for driving the output pin of the organic EL panel, without assigning a specific one of the output side transistors of the current mirror circuit. That is, it is enough that the currents of the current output circuits 3 and 4 of the column IC driver 12 correspond to the drive current for driving the output pin of the organic EL panel.

Further, the reference current generator circuit in this embodiment is constructed with the constant current circuit having the operational amplifier. The operational amplifier may be a general differential amplifier.

Further, although the current drive circuit of this embodiment includes one input side drive transistor and a plurality of output side transistors in current mirror connection to the input side drive transistor, a plurality of the input side drive transistors may be provided. Further, the input side transistor Tra of the current mirror circuit may be arranged in a center of the output side transistors Trb to Trn as in the case of Japanese Application JP2002-82662.

Although the embodiment is constructed with MOS FETs mainly, the MOS FETs may be replaced by bipolar transistors. Further, in the described embodiment, the N channel (or npn) transistors can be replaced by P channel (or pnp) transistors and the P channel (or pnp) transistors can be replaced by N channel (or npn) transistors. In such case, the power source voltage is negative and the upstream side transistors should be provided on the downstream side.

What is claimed is:

1. A display drive system having ICs comprising a first IC and a second IC, each of said first IC and said second IC comprising:

a current mirror circuit having an input side transistor supplied with a predetermined drive current and a plurality of output side parallel transistors, from which drive currents to be supplied to terminal pins of a display panel are derived; and a current output circuit which generates a current having a first value in response to an output current of one of said output side parallel transistors;

wherein said second IC of said display drive system further comprises:

a current generator circuit which generates said predetermined drive current of said second IC in response to a predetermined input current and being supplied with said current having said first value of said current output circuit of said first IC.

2. The display drive system according to claim 1, wherein said current output circuit of said first IC generates the current having the first value in response to an output current of a certain output side transistor connected in parallel to said output side transistors of said current mirror circuit of said first IC.

3. The display drive system according to claim 2, wherein said current generator circuit includes a reference current generator circuit for generating said predetermined drive current as a predetermined reference current.

4. The display drive system according to claim 3, wherein the reference current generator circuit includes a first resistor, a second resistor, and an amplifier, said amplifier generating a current in response to a difference between voltages output across said first and second resistors as the predetermined reference current.

5. The display drive system according to claim 4, wherein the first and second resistors have substantially identical resistance values.

6. The display drive system according to claim 1, wherein said current generator circuit includes a reference current generator circuit for generating said predetermined drive current as a predetermined reference current.

7. The display drive system according to claim 6, wherein the reference current generator circuit includes a first resistor, a second resistor, and an amplifier, said amplifier generating a current in response to a difference between voltages output across said first and second resistors as the predetermined reference current.

8. The display drive system according to claim 7, wherein the first and second resistors have substantially identical resistance values.

9. The display drive system according to claim 1, wherein the plurality of output side parallel transistors are P channel MOSFETs whose sources are connected to a power source line.

10. A display drive system having ICs comprising a first IC and a second IC, each of said first IC and said second IC comprising:

current mirror circuit means having an input side transistor supplied with a predetermined drive current and a plurality of output side parallel transistors, for deriving drive currents that are supplied to terminal pins of a display panel; and current output circuit means for generating a current having a first value in response to an output current of one of said output side parallel transistors;

wherein said second IC of said display drive system further comprises:

current generator circuit means for generating said predetermined drive current of said second IC in response to a predetermined input current and being supplied with said current having said first value of said current output circuit means of said first IC.

11. The display drive system according to claim 10, wherein said current output circuit means of said first IC generates the current having the first value in response to an output current of a certain output side transistor connected in parallel to said output side transistors of said current mirror circuit means of said first IC.

12. The display drive system according to claim 11, wherein said current generator circuit means includes a reference current generator circuit means for generating said predetermined drive current as a predetermined reference current.

13. The display drive system according to claim 12, wherein the reference current generator circuit means includes a first resistor, a second resistor, and an amplifier, said amplifier generating a current in response to a difference between voltages output across said first and second resistors as the predetermined reference current.

14. The display drive system according to claim 13, wherein the first and second resistors have substantially identical resistance values.

15. The display drive system according to claim 14, wherein the plurality of output side parallel transistors are P channel MOSFETs whose sources are connected to a power source line.

16. The display drive system according to claim 10, wherein said current generator circuit means includes a reference current generator circuit means for generating said predetermined drive current as a predetermined reference current.

17. The display drive system according to claim 16, wherein the reference current generator circuit means includes a first resistor, a second resistor, and an amplifier, said amplifier generating a current in response to a difference between voltages output across said first and second resistors as the predetermined reference current.

18. The display drive system according to claim 17, wherein the first and second resistors have substantially identical resistance values.

19. The display drive system according to claim 10, wherein the plurality of output side parallel transistors are P channel MOSFETs whose sources are connected to a power source line.

* * * * *